United States Patent [19]

Shimoma et al.

[11] Patent Number: 4,580,076

[45] Date of Patent: Apr. 1, 1986

[54] COLOR CATHODE RAY TUBE

[75] Inventors: Taketoshi Shimoma, Isezaki; Kumio Fukuda; Kenichi Kobayashi, both of Fukaya, all of Japan

[73] Assignee: Tokyo Shibaura Denki Kabushiki Kaisha, Kawasaki, Japan

[21] Appl. No.: 469,449

[22] Filed: Feb. 24, 1983

[30] Foreign Application Priority Data

Mar. 31, 1982 [JP] Japan ..... 57-51347
Apr. 15, 1982 [JP] Japan ..... 57-61720

[51] Int. Cl.[4] ..... H01J 29/06
[52] U.S. Cl. ..... 313/402; 313/407
[58] Field of Search ..... 313/402, 407, 403, 404, 313/405, 406, 408, 479; 315/8, 85

[56] References Cited

U.S. PATENT DOCUMENTS 4,019,085 4/1977 Sakata .
4,229,675 10/1980 Matsuki et al. ..... 313/402

FOREIGN PATENT DOCUMENTS 2551327 8/1976 Fed. Rep. of Germany .
53-16575 2/1978 Japan ..... 313/407
2000902 1/1979 United Kingdom .

*Primary Examiner*—David K. Moore
*Attorney, Agent, or Firm*—Cushman, Darby & Cushman

[57] ABSTRACT

A color cathode ray tube having an inner magnetic shield for controlling the magnetic field distribution inside of the tube. The inner shield is formed to have a pair of long side walls and a pair of short side walls provided along an inner wall of the tube's funnel. The long side wall has formed therein more than two elongated openings in each of two regions divided by a center of the long side wall. The center of the openings are offset toward the center of the long side wall.

7 Claims, 22 Drawing Figures

COLOR CATHODE RAY TUBE

BACKGROUND OF THE INVENTION

The present invention relates in general to the structure of color cathode ray tubes, more particularly, the invention relates to the structure of the tube's inner magnetic shield.

FIG. 1 is a partially cut-away side view of a color cathode ray tube to which the present invention pertains. A funnel 2 is joined to an outer pheriphery of an approximately rectangular face plate 4. A phosphor screen 6 is formed on an inner surface of face plate 4. Phosphor screen 6 has regularly arranged red, blue and green phosphor stripes. Each phosphor stripe extends along a direction defined by the short sides of face plate 4. A neck 8 is joined to an end of funnel 2. An electron gun 10 is disposed within neck 8. A deflection apparatus 12 is mounted on an outer surface of funnel 2 and around neck 8. A color selection electrode 14 is mounted within the tube so as to oppose to phosphor screen 6. Color selection electrode 14 includes an aperture portion 16 having a plurality of apertures and is held in place by a frame 18 and resilient support members 20 attached to frame 18. Color selection electrode 14 is attached to pins 22 which are welded to face plate 4. An inner magnetic shield 24 is mounted to color selection electrode 14 and is arranged along an inner wall of funnel 2. Inner magnetic shield 24 is provided for shielding electron beams, generated by electron gun 10, from the earth's magnetic field.

Referring now to FIG. 2, there is shown in perspective view a conventional inner magnetic shield 24. This funnel-shaped inner magnetic is well known as a basic type of inner magnetic shield. Generally inner magnetic shield 24 is made from a ferromagnetic metal plate including iron as its chief component. The thickness of the metal plate is selected to be in the range of 0.1 mm to 0.3 mm for ease in fabrication. However, an inner magnetic shield having such a thickness is too thin to completely shield the electron beams from the magnetic flux. Thus the beam paths are distorted and they strike the wrong points on the inner surface of the tube's face thereby affecting color purity.

One approach to solving this problem was to try to align the direction of lines of magnetic force with the electron beam path or to convert the direction of lines of magnetic force to another direction which does not affect the color purity. The effect of the magnetic shield will be further explained below.

First, the magnetic field component affecting the color purity will be discussed. Generally, a phosphor screen of a color cathode ray tube has a plurality of phosphor stripes continuously extending in the vertical direction of the tube's face plate. Generally, the vertical direction of the face plate corresponds to the direction of the short side of the face plate. Therefore a beam deviation in the vertical direction does not degrade the color purity. For the purposes of this discussion, we will denote the horizontal axis line of the face plate "x", the vertical axis line "y" and the tube axis "z". The magnetic components affecting the color purity are a y axial magnetic field component "By" and a tube axial magnetic field component "Bz". A charged particle in the presence of a magnetic field develops a "Lorentz's force" in accordance with the following relation:

$$F = qv \times B$$

in which q is the quantity of electric charge of the particle, v is the velocity of the charged particle and B is magnetic flux density through which the charged particle is traveling. When the charged particle is an electron, the relation is further developed to $$F = -ev \times B$$

in which e is the charge of an electron. The beam deviation in the horizontal direction affects the color purity. Force Fx affecting the electron beam in the horizontal direction is indicated by the following relation:

$$Fx = -e\,(vy\,Bz - vz\,By)$$

in which vy is a horizontal component of the velocity and vz is a tube axial component of velocity. This relation implies that By and Bz cooperate with vz and vy, respectively to affect the color purity.

Referring now to FIGS. 3A and 3B, the deviation direction of the electron beam is illustrated. Arrows 26 indicate the deviation directions for electron beams in both the upper and lower portions of a color cathode ray tube viewed from the observer side. Both FIGS. 3A and 3B illustrate the cases wherein the color cathode ray tube is located in the northern part of the earth and its face plate is directed north. FIG. 3A shows the electron beam deviation caused by the horizontal component Bz of the earth's magnetic field and the vertical component vy of the electron beam velocity deflected by the deflection apparatus. In the upper part of the screen, the beam is offset to the left. In the lower part of the screen the beam is offset to the right. FIG. 3B shows the electron beam deviation caused by the vertical component By of the earth's magnetic field and the tube's axial component vz of the electron beam velocity. The electron beam is offset to left over the entire screen. These are the effects of beam deviation caused by the earth's magnetic field.

Referring now to FIG. 4, there is shown a known inner magnetic shield 30. Such a shield 30 is disclosed in Japanese Patent Disclosure No. 15001/1978. Magnetic shield 30 has a notch 31 in its short side walls 32. Some magnetic flux components in the z direction, which would be absorbed in the short side wall of prior art magnetic shields (shown in FIG. 2) are directed to the long side walls 33. Accordingly, some horizontal components Bz are converted into vertical components By. That is, vertical component By is increased in the upper part of the screen and vertical component By is decreased in the lower part of the screen. These converted magnetic flux component affect the electron beam deviation in the opposite direction to the deviation caused by the horizontal component Bz. The beam deviation is thereby reduced and the color purity is remarkably increased when the color cathode ray tube is oriented in the north or south direction.

However, when the color cathode ray tube is oriented east or west, the magnetic flux easily passes the region through which the electron beam is passing because of the notches in the side walls. The magnetic flux distribution in that region increases and is deformed by the long side walls 33 of the magnetic shield. The shape of the magnetic flux distribution becomes a barrel shape as shown in FIG. 5. Consequently, the vertical components By are generated at the four corners of the screen as shown in FIG. 5. As a result, a beam deviation toward the center after 35, as shown by arrows 35 occurs in the upper part of the screen, and a beam deviation toward the outside as shown by arrows 36 occurs in the lower part of the screen. A trapezoidal shaped beam miss-landing pattern thereby occurs.

To overcome this drawback, another magnetic shield as shown in FIG. 6 was proposed in Japanese Patent Disclosure No. 13,253/1979. This magnetic shield 38 includes a notch 40 along vertical axis y in the long side wall 41. Notch 40 forms high magnetic resistant portion, which impedes the concentration of magnetic flux in the long side walls 41. Thus the undesirable deformation of the magnetic flux distribution, such as barrel shaped distribution, is prevented. FIG. 7 shows the magnetic field distribution in the inner magnetic shield 38 shown in FIG. 6. This inner magnetic shield has high magnetic resistant parts on vertical axis y. Therefore, the reformation of the local flux distribution is as shown in FIG. 7, and the distribution of the magnetic field acquires harmonic components. On the four corners of the screen the high magnetic resistant part does not have enough effect, so that the same beam deviation as shown in FIG. 5 still remains. However, near the high magnetic resistant part, that is near the vertical axis y the beam deviation direction is opposite to the direction as shown in FIG. 5. This magnetic shield configuration causes local beam deviation near notch 40 and this local beam deviation makes it difficult to cancel the total beam deviation (which includes the beam deviation resulting from other factors) by adjusting the deflection apparatus.

Further, the high magnetic resistant part is required to have enough width to affect the electron beam within the effective screen area, so that additional drawbacks result. When the color cathode ray tube is directed to the north or south, the beam deviation near the high magnetic resistance part becomes large because the weak function of converting the tube axial magnetic field into the vertical magnetic field near the high magnetic resistance part. The resulting beam deviation is also local.

FIG. 8 shows the yet another prior art inner magnetic shield 42 described in Japanese Utility Model Publication No. 27,957/1980. The side wall 44 has openings 45 for forming anisotropy in the magnetic resistance to reduce the demagnetizing power. Opening 45 also contributes to the heat-dispersion of the shadow mask. This inner magnetic shield 42 is not intended to prevent the beam deviation.

As discussed above, prior art inner magnetic shield structures can not render the beam deviation sufficiently small over the entire screen.

SUMMARY OF THE INVENTION

The present invention provides a novel magnetic shield structure that overcomes the above mentioned drawbacks. The inner magnetic shield of the present invention has a pair of short side walls and a pair of long side walls. Each short side wall has a triangular notch and each long side wall has more than two openings forming high magnetic resistance portions. The openings are provided for generating leakage flux and for reforming the barrel shaped magnetic field distribution into a uniform distribution when the color cathode ray tube is oriented east or west. More than two openings can be more effective in reforming the barrel shaped magnetic field distribution into a more uniform distribution than can only one opening provided at the center of the long side wall. To make more uniform a magnetic field distribution, the openings are advantageously distributed in two regions of the shield divided by the center line of the long side wall. Preferably, the center of the opening in each region is offset toward the center line. When the color cathode ray tube is oriented east or west, the magnetic field distribution in the tube can be made uniform, and the beam deviation thereby is decreased and color purity is improved.

Specifically, the present invention provides a color cathode ray tube having:

an approximately rectangular face plate having a pair of long sides and a pair of short side;

a funnel having first and second open ends, the first open end is connected to the face plate;

a neck connected to the second open end of the funnel;

a phosphor screen coated on the face plate and including a plurality of phosphor stripes regularly arranged, the phosphor stripes extend in a direction parallel to the short side of the face plate;

an electron gun disposed in the neck and emitting a plurality of electron beams, where the direction of the electron beam is parallel to a tube axis;

a color selection electrode facing the phosphor screen and having a plurality of apertures for the electron beams to pass through a deflecting apparatus mounted on outer sides of the neck and the funnel for scanning the electron beams; and an inner magnetic shield attached to the color selection electrode and extending along the funnel, said inner magnetic shield comprising:

a pair of short side walls corresponding to the short sides of the face plate and attached to the color selection electrode; and a pair of long side walls corresponding to the long sides of said face plate and attached to the color selection electrode, the pair of long side walls being divided into four portions by first and second planes, the first plane including the tube axis and being parallel to the long side of the face plate and the second plane including the tube axis and being parallel to the short side of the face plate, each of said four portions having at least one elongated opening paralled to the direction of the electron beam paths when the electron beams are deflected by the deflection apparatus, the width of the elongated opening being less than one third of length of the elongated opening, and the center of the opening being offset toward the second plane.

BRIEF DESCRIPTION OF THE DRAWINGS

The invention will be described in detail with reference to the accompanying drawings, wherein.

DETAILED DESCRIPTION OF THE PREFERRED EMBODIMENT

Figure 1:
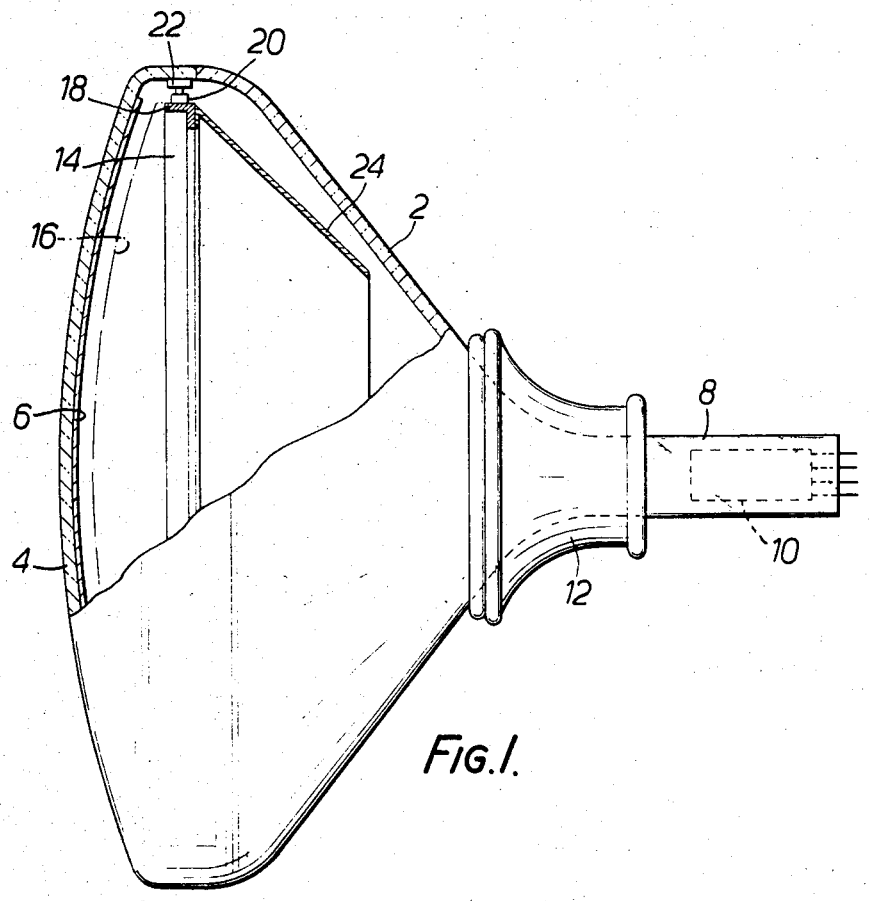
FIG. 1 shows a color cathode ray tube of the general type to which the present invention pertains.
Figure 2:
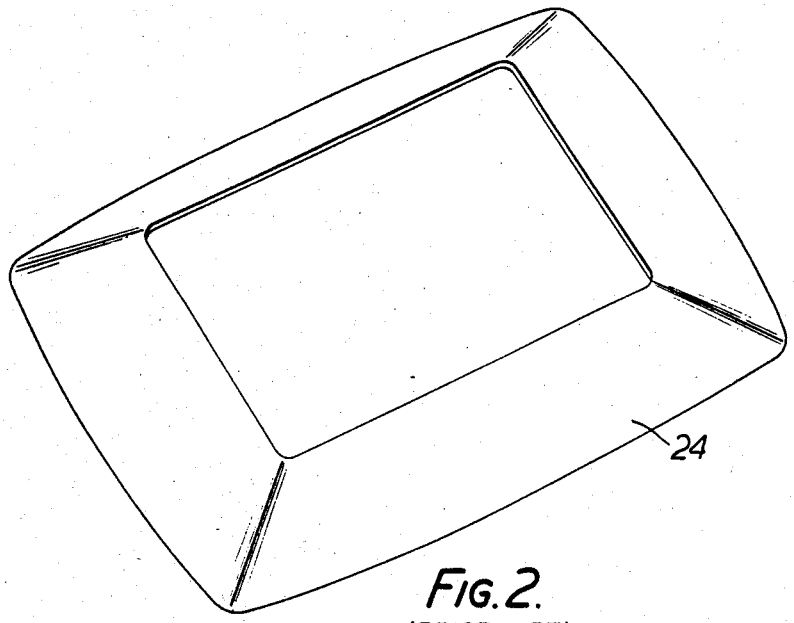
FIG. 2. (PRIOR ART)
FIG. 2 is a perspective view of prior art inner magnetic shield.
Figure 3A:
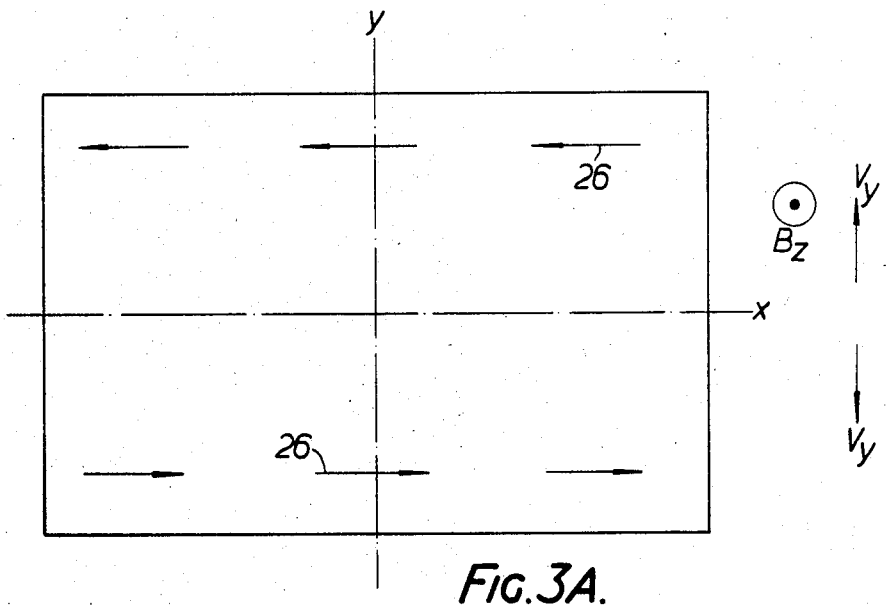
FIG. 3A schematically illustrates beam deviation caused by the interaction of the horizontal component of the earth's magnetic field with the vertical component of electron beam velocity.
Figure 3B:
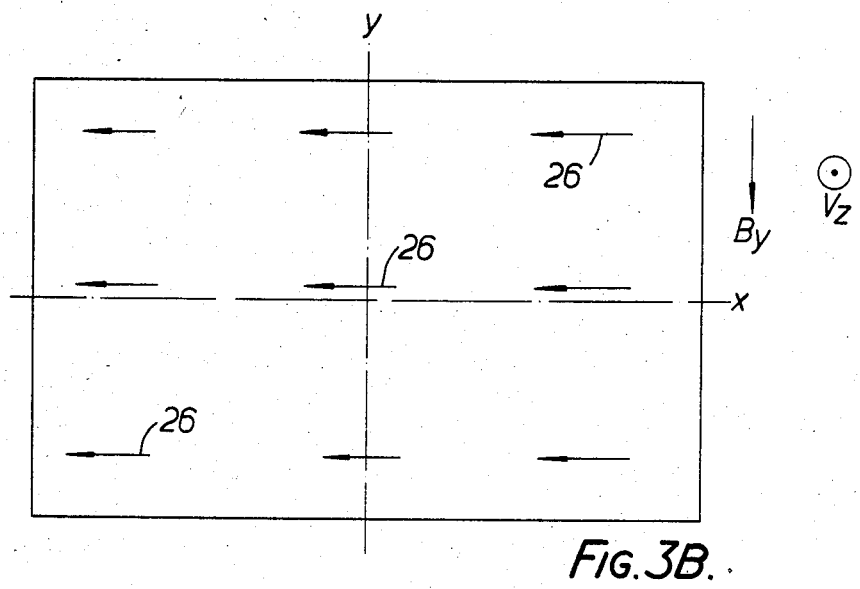
FIG. 3B schematically illustrates beam deviation caused by the interaction of the vertical component of the earth's magnetic field with the axial component of electron beam velocity.

The cathode ray tube of the present invention is of the general type shown in FIG. 1, except that the inner magnetic shield 24 is significantly improved. Therefore the detailed description of the invention will focus on this inner magnetic shield.

Figure 9:
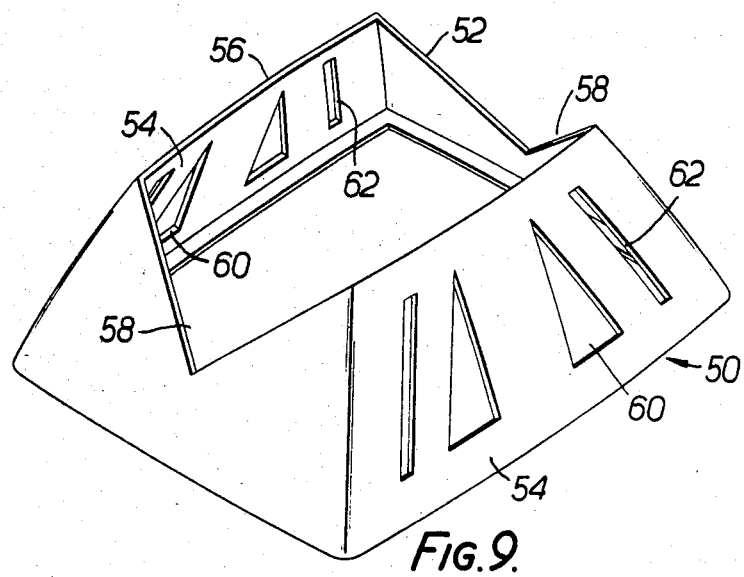
FIG. 9 is a perspective view of the inner magnetic shield according to the present invention.
Figure 10:
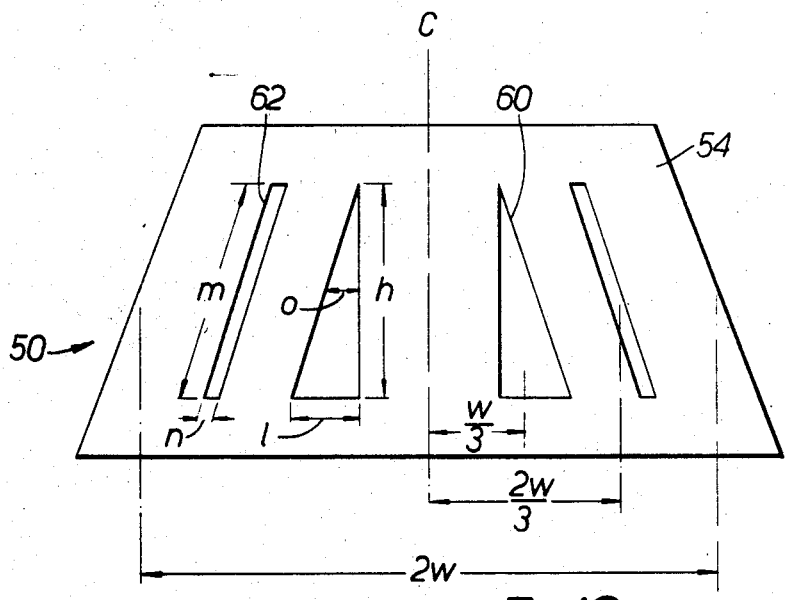
FIG. 10 is a side view of the inner magnetic shield shown in FIG. 9.
Figure 11:
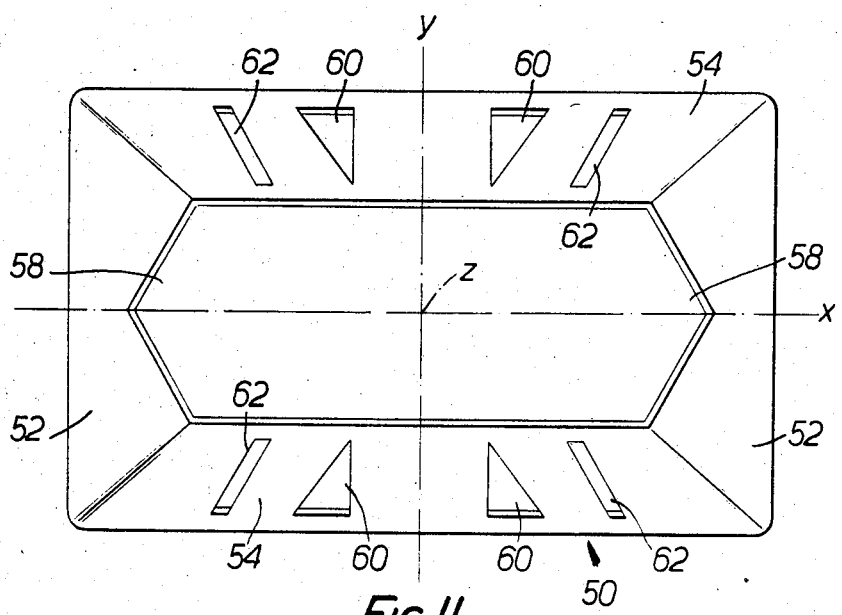
FIG. 11 is a top view of the inner magnetic shield shown in FIG. 9.

Referring to FIG. 9 there is shown a perspective view of an inner magnetic shield 50 according to the present invention. FIG. 10 is a side view of the FIG. 9 shield showing its long side wall more clearly and FIG. 11 is a top view of the FIG. 9 shield. Inner magnetic shield 50 is made of a ferromagnetic material and is formed in a funnel or rectangular cone-like shape having a pair of short side walls 52 and a pair of long side walls 54. short side wall 52 is formed with an approximately triangular notch 58. Each long side wall 54 has two triangular openings 60 and two elongated slit openings 62 therein.

For the purpose of describing the positions of the various openings such as 60 and 62, FIG. 11 shows inner magnetic shield 50 divided (not actually physically divided) into four portions by two planes X and Y which are perpendicular to the page. A triangular opening 60 and an elongated opening 62 are included in each of the four portions formed by the two planes. Plane X includes the axis z of the tube and is parallel to the long side of the face plate. Plane Y also includes tube axis z and is parallel to the short side of the face plate. The width of triangular opening 60 becomes greater toward the phosphor screen side of shield 50. Elongated opening 62 is aligned along the electron beam traveling path when the electron beam is deflected near the inner magnetic shield 50 by deflection apparatus 12. When the mean width of long side wall 54 is 2W, (where W is a scaling factor) as shown in FIG. 10, the centers of the triangular and elongated openings are at W/3 and 2W/3, respectively from plane Y. The heights h of the triangular openings are about three times the lengths 1 of their respective bases. The length m of elongated opening 62 is about fifteen (15) to twenty (20) times the width n thereof. The width o (at the midpoint of the height h) triangular opening 60 is about five to six times the width n of elongated opening 62. Triangular opening 60 and elongated opening 62 in each portion are symmetric with respect to planes X and Y, respectively.

The advantages of the invention will be described below. Triangular notch 58 of the short side wall minimizes the beam deviation when the color cathode ray tube is aligned in a northerly or southerly direction as discussed in the background section of this document. The functions of the triangular openings 60 and the elongated opening 62 are explained below.

Figure 4:
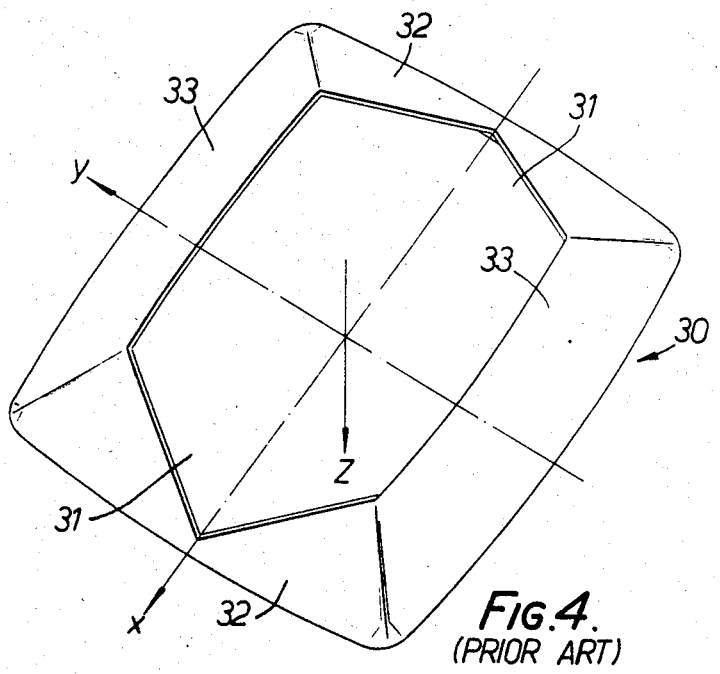
FIG. 4. (PRIOR ART)
FIG. 4 shows another prior art inner magnetic shield.
Figure 5:
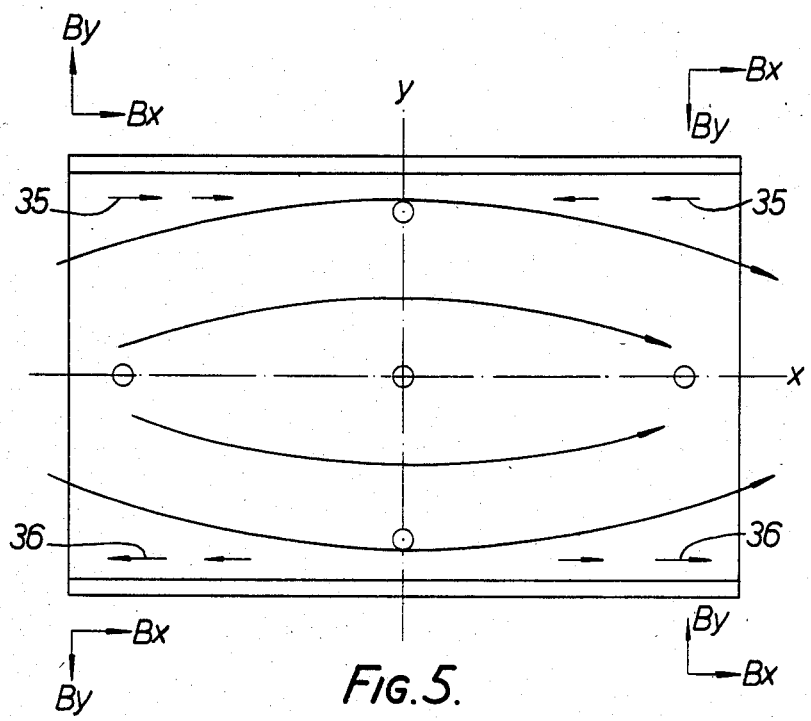
FIG. 5 graphically illustrates a magnetic field distribution pattern reformed by the inner magnetic shield shown in FIG. 4.
Figure 12:
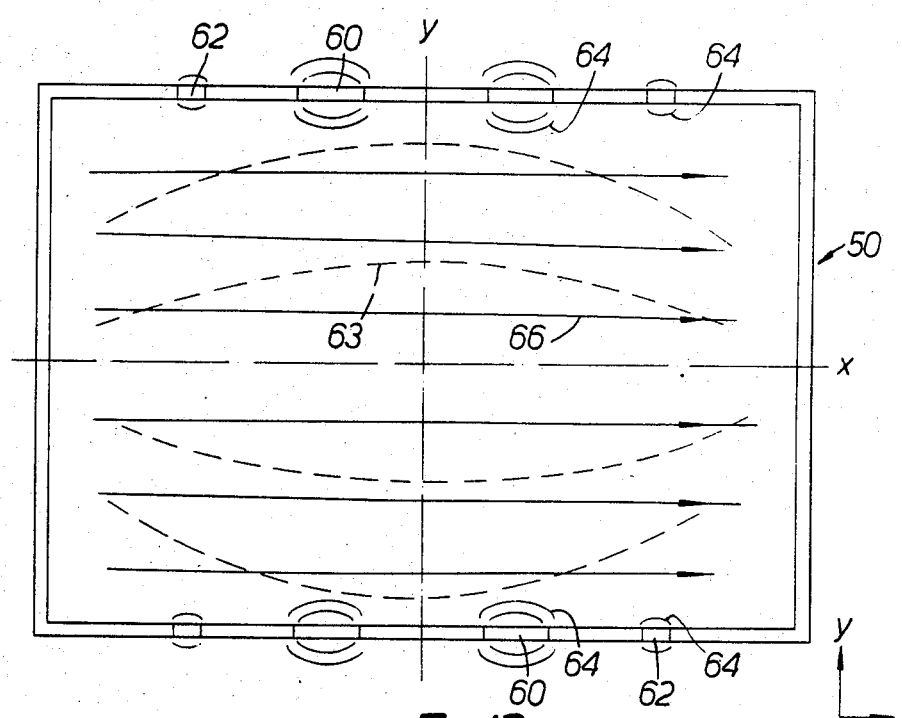
FIG. 12 illustrates the effect on a magnetic field distribution pattern by the magnetic shield of the present invention shown in FIG. 9.

FIG. 12 shows a cross section of inner magnetic shield 50 and the magnetic flux distribution when the color cathode ray tube is oriented in an easterly direction. The horizontal component of the earth's magnetism is directed in the x direction. Broken lines 63 show the magnetic field distribution deformed by the prior art inner magnetic shield shown in FIG. 4. This magnetic field distribution is barrel-shaped. However, according to the present invention, leakage magnetic flux 64 occur at the triangle openings 60 and the elongated openings 62. These leakage magnetic flux reform the barrel-shaped magnetic flux distribution into a uniform distribution as indicated by line 66. Particularly the magnetic field distribution in the region of the screen is formed most uniformly. The wider the opening, the stronger the leakage magnetic field. The width and the location of the openings are selected to form the most uniform magnetic field distribution. The triangle opening generates strong and wide leakage flux, and the elongated opening generates relatively weak and local leakage flux. These leakage magnetic flux must not affect the electron beams directly, which electron beams reach the effective screen area. However, these leakage magnetic flux affect indirectly those electron beams. That is, leakage magnetic flux pushes back the barrel shape field (indicated by broken lines 63) which field is formed by an inner magnetic shield without the triangular opening and elongated opening. The barrel shaped field is reformed to a uniform field by the leakage magnetic flux. However, each opening inevitably causes harmonic components of the magnetic field near the opening. Therefore, making the magnetic field distribution uniform means only that the magnetic field distribution within the electron beam passing area, which corresponds to the screen, is made uniform. Thus, the whole of the magnetic field distribution inside the CRT is not made uniform. The width of these openings are preferably less than one third of their length in order to generate the required harmonic components is the magnetic field.

Figure 13:
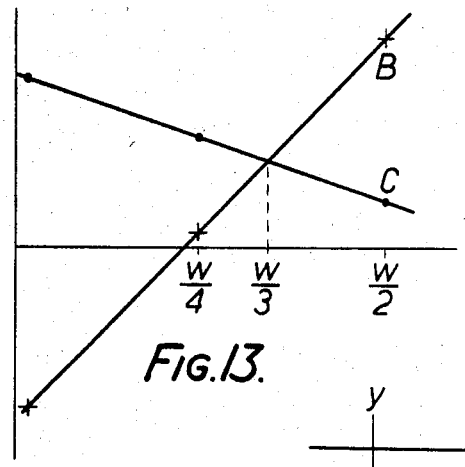
FIG. 13 is a chart showing a relation between the beam deviation and the position of the triangular opening.
Figure 14:
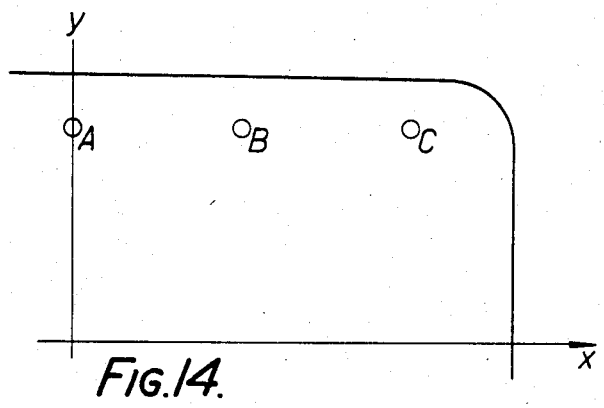
FIG. 14 shows three points on the screen.

Now the location of the triangle opening in the above described embodiment will be discussed. The triangle opening is wide enough so that it has a relatively large influence on the electron beams. Referring now to FIG. 13, there is shown a relation between the location of the triangular opening and the quantity of beam deviation. A horizontal axis denotes the location of the triangular opening and a vertical axis denotes the beam deviation. The location of the triangular opening shows the distance between the center of the opening and the center line c of the long side wall shown in FIG. 10. Curves B and C plotted in FIG. 13 denote the beam deviations measured at the points B and C on the screen shown in FIG. 14. Point B indicates the middle point between the corner of the screen and the y axis, and point C indicates the corner. The beam deviation at the point C decreases according to the location of the opening as the opening is moved away from the center line c. On the contrary, the beam deviation at B increases as the hole is moving away from the center line C. FIG. 13 shows that the location of the triangular opening changes the degree to which the magnetic field is reformed even if the size of the triangular opening is the same. In this embodiment, the preferable location of the triangular opening is W/3 as seen from FIG. 13.

The elongated opening 62 is provided for making the magnetic field distribution even more uniform. It decreases the beam deviation at the corner of the screen. When the elongated opening 62 is wide, the whole magnetic field distribution is undesirably reformed. Therefore, the elongated opening 62 is required to affect the magnetic field distribution with a smaller influence than that of the triangular opening 60.

According to the present invention, the barrel shaped magnetic field distribution, which causes the beam deviation, can be made more uniform while suppressing undesirable harmonic components by providing at least two openings in each long side wall of the inner magnetic shield. That is, by providing a plurality of openings in the long side wall. In particular, these openings are offset toward the center of the long side wall. They can reform the barrel-shaped magnetic field, which normally results when these openings are not provided in the long side wall. By providing openings as taught herein there is a subtantially uniform magnetic field without harmonic components or with fewer harmonic components in the magnetic field. The beam deviation is thereby decreased and the color purity of a tube in which the inner magnetic shield is placed, is remarkably improved.

Further, another important merit of the holes 60 and 62 is that the present invention scarcely affect the beam deviation which occurs when the color cathode ray tube is oriented north or south. The reason is that an the opening are provided along the beam traveling direction. In the prior art inner magnetic shield shown in FIG. 4, the beam deviation occurred when the tube is pointed east or west and the beam deviation when the tube is directed north or south cancel each other. However, the present invention improves the color purity independent of the direction in which the tube is oriented.

Furthermore, the present invention can be used in other color cathode ray tubes which are used in different geographic regions where the earth's magnetic distributions are different from each other. Using the principles of the present invention, it is not necessary to independently design tubes for each geographic area.

Figure 6:
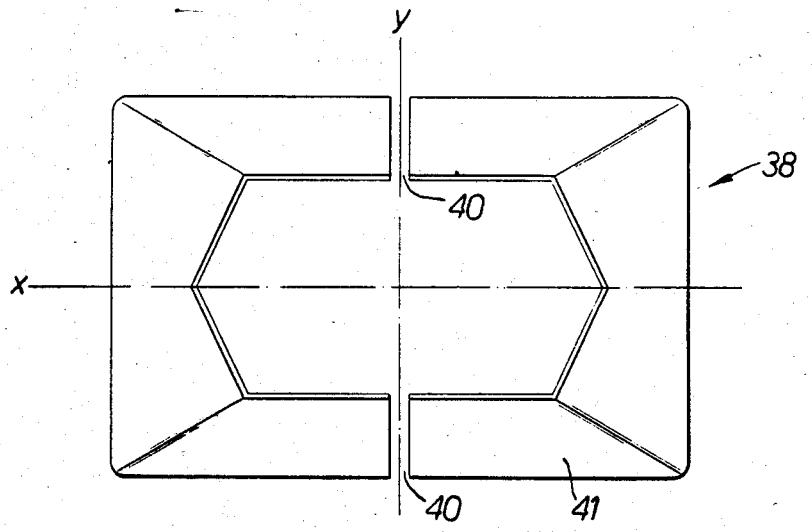
FIG. 6. (PRIOR ART)
FIG. 6 shows another prior art inner magnetic inner shield.
Figure 7:
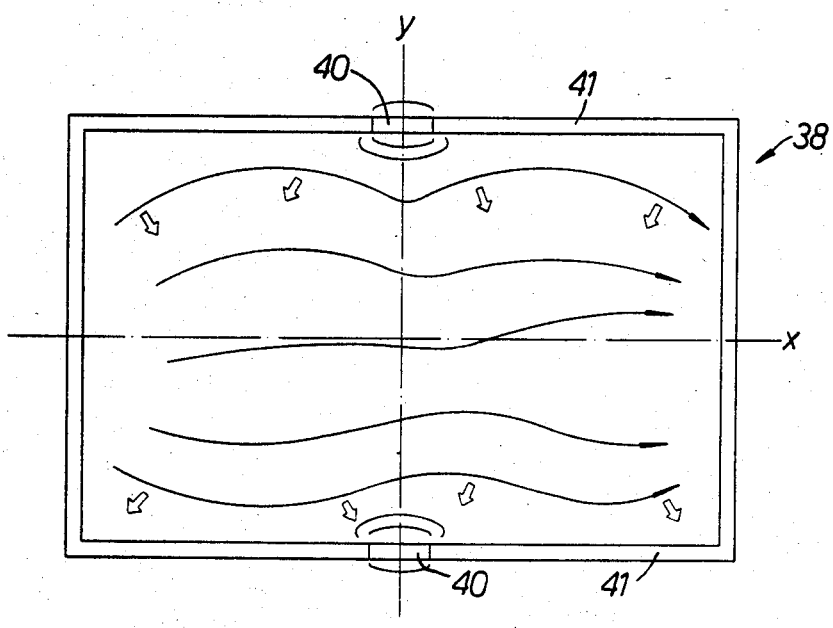
FIG. 7 graphically illustrates a magnetic field distribution pattern reformed by the inner magnetic shield shown in FIG. 6.
Figure 8:
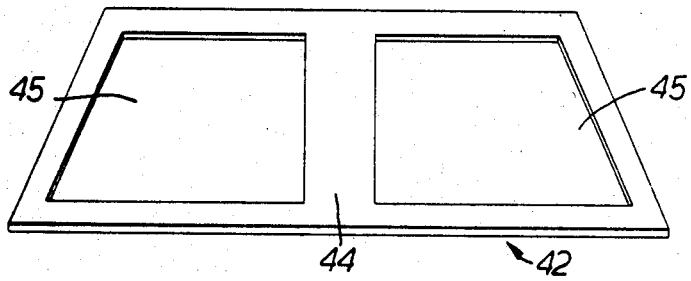
FIG. 8. (PRIOR ART)
FIG. 8 shows yet another prior art inner magnetic shield.
Figure 15:
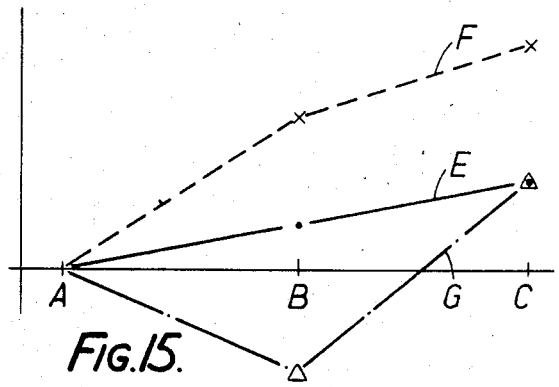
FIG. 15 charts the relation between beam deviation and the beam position on the screen when the color cathode ray tube is oriented east or west.
Figure 16:
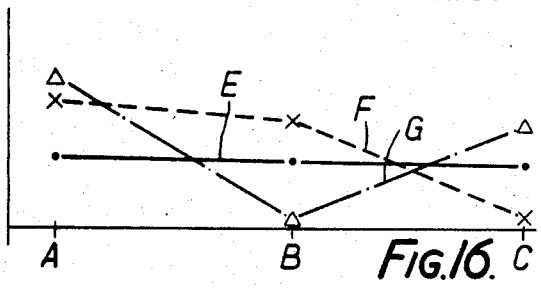
FIG. 16 charts the relation between beam deviation and the position on the screen when the color cathode ray tube is oriented north or south.

Referring now to FIGS. 15 and 16, there are plotted beam deviation curves. FIG. 15 shows the case when the tube is directed east or west and FIG. 16 shows the case when the tube is directed north or south. A, B and C on the horizontal axis denote the locations on the screen, which correspond to the location A, B and C shown in FIG. 14. A curve E denotes the above described invention, a curve F denotes the prior art inner magnetic shield shown in FIG. 4 and a curve G denotes the prior art inner magnetic shield shown in FIG. 6. The present invention is superior to the prior art in the absolute quantity and uniformity of the beam deviation as can be seen in FIGS. 15 and 16.

Figure 17:
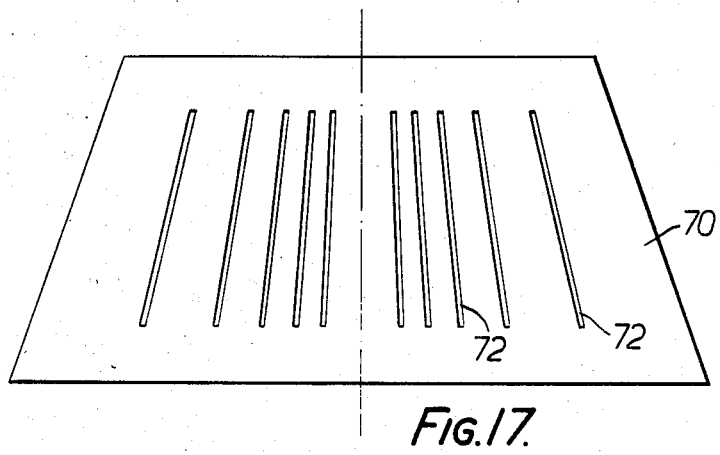
FIG. 17 is a side view of an alternative embodiment of the present invention.

Referring now to FIG. 17, another embodiment of the inner magnetic shield according to the present invention is illustrated. Long side wall 70 has a plurality of elongated slit openings 72 parallel to the beam traveling direction. The density of elongated slit openings 72 increases toward the center of the long side wall.

Figure 18:
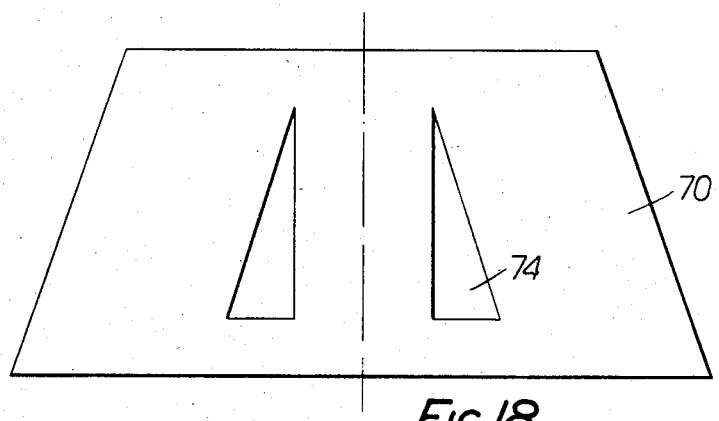
FIG. 18 is a side view of another alternative embodiment of the present invention.

Referring now to FIG. 18 there is shown another embodiment of the present invention. Two triangular openings 74 are provided in long side wall 70. This embodiment can be applied to a small color cathode ray tube.

Figure 19:
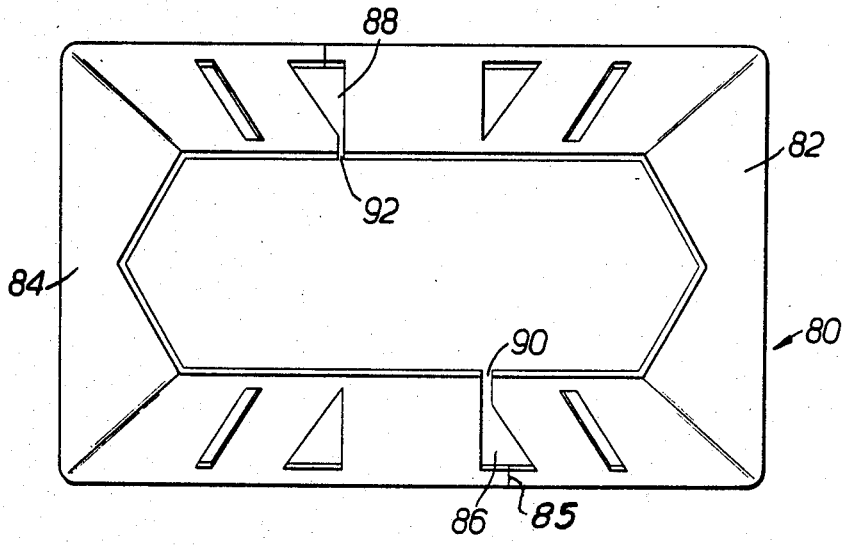
FIG. 19 is a top view of another alternative embodiment of the present invention.

The inner magnetic shield according to the present invention can be assembled from divided parts for facilitating the manufacture of the CRT even though the described embodiment consist of one part. FIG. 19 shows such an embodiment. The inner shield 80 is assembled from two parts 82 and 84. The two parts are welded together at 85 and 87 through openings 86 and 88. The assembled two parts form gaps 90 and 92 at the electron gun side of the shield. Adjusting the width of these gaps can control the magnetic field distribution.

Figure 20:
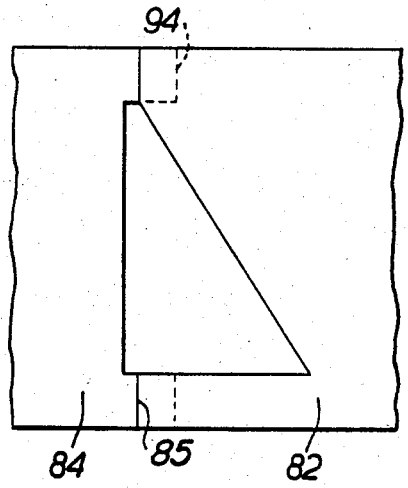
FIG. 20 is an enlarged side view of another alternative embodiment of the invention.
Figure 21:
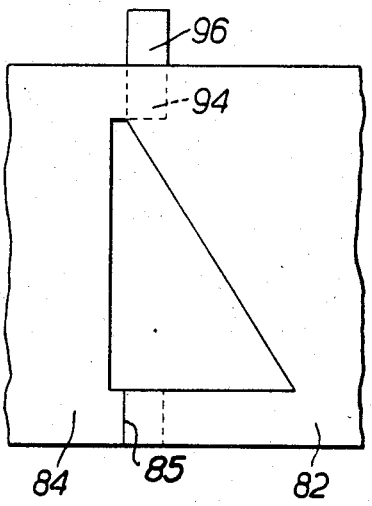
FIG. 21 is an enlarged side view of a further alternative embodiment of the invention.

Further, divided parts 82 and 84 can be fixed at the electron gun side of the shield as shown in FIGS. 20 and 21. One part 84 has a tab 94, as shown in FIG. 20, at the electron gunside. Alternatively, parts 82 and 84 may be provided with tabs 96 and 94, respectively, as shown. Both parts 82 and 84 have tabs respectively as shown in FIG. 21, Tab 96 is bent over and both tabs 94 and 96 are fixed. These embodiments can control the size of the electron gun side opening for beam passing and increase the mechanical strength of the magnetic shield.

While the invention has been described in connection with what is presently considered to be the most practiacal and preferred embodiments, it is to be understood that the invention is not to be limited to the disclosed embodiments but on the contrary, is intended to cover various modifications and equivalent arrangements included within the spirit and scope of the appended claims so as to encompass all such modifications and equivalent structures.

What is claimed is:

1. A color cathode ray tube comprising:

a face plate having a pair of long sides and a pair of short sides;

a funnel having first and second open ends, said first open end being connected to said face plate;

a neck connected to said second open end of said funnel;

a phosphor screen coated on said face plate and including a plurality of phosphor stripes regularly arranged, said phosphor stripes extending in a direction parallel to said short side of said face plate;

an electron gun disposed in said neck for emitting a plurality of electron beams, a direction of said electron beams defining a tube central axis;

a color selection electrode positioned between said electron gun and said phosphor screen and having a plurality of apertures for passing said electron beams;

a deflection apparatus for deflecting said electron beams to scan said screen; and an inner magnetic shield for affecting a magnetic field distribution in said cathode ray tube extending along said funnel said shield comprising:

a pair of short side walls corresponding to said short sides of said face plate, and a pair of long side walls corresponding to said long sides of said face plate, said pair of long side walls having four portions delimited by first and second imaginary planes, said first plane including said tube central axis and being parallel to said long side of said face plate and said second plane including said tube central axis and being parellel to said short side of said face plate, each of said four portions having at least one elongated opening parallel to said electron beam direction when said electron beams are deflected by said deflection apparatus, the width of said elongated opening being less than one third of its length, the center of said opening being offset toward said second plane said elongated opening affecting said magnetic field distribution to produce a nearly uniform magnetic field distribution.

2. A color cathode ray tube according to claim 1, wherein said elongated opening is triangular, and the width of said elongated opening is wider at a side thereof facing said phosphor screen than the width of a side thereof facing said electron gun.

3. A color cathode ray tube according to claim 1, wherein each of said four portions of said long side walls have a plurality of elongated openings.

4. A color cathode ray tube according to claim 3, wherein the density of said elongated openings is greater near the center of said long side wall than near the end of said long side wall.

5. A color cathode ray tube according to claim 1, wherein said inner shield comprises two or more than two individual parts.

6. A color cathode ray tube according to claim 5, wherein said individual parts are joined at a weld joint through said elongated opening.

7. A color cathode ray tube according to claim 1, wherein said short side wall has a triangle notch therein.

* * * * *